United States Patent [19]

Brooks et al.

[11] Patent Number: 4,707,589

[45] Date of Patent: Nov. 17, 1987

[54] HEATING APPARATUS

[75] Inventors: Steve M. Brooks, Chingford; David R. May, Cheshunt, both of England

[73] Assignee: Thorn Emi Patents Limited, Hayes, England

[21] Appl. No.: 929,793

[22] Filed: Nov. 13, 1986

Related U.S. Application Data

[62] Division of Ser. No. 733,802, May 14, 1985, Pat. No. 4,639,579.

[30] Foreign Application Priority Data

May 15, 1984 [GB] United Kingdom ..... 8412339

[51] Int. Cl.[4] ..... H05B 3/76

[52] U.S. Cl. ..... 219/464; 219/446; 219/466

[58] Field of Search ..... 219/464, 445, 446, 465, 219/466, 468, 449, 354, 553; 313/315, 316

[56] References Cited

U.S. PATENT DOCUMENTS

| | | | |
|---|---|---|---|
| 2,600,605 | 6/1952 | Backer | 219/466 |
| 2,988,634 | 6/1961 | Miskella | 219/553 X |
| 3,330,939 | 7/1967 | Jacobs | 219/449 |
| 3,355,574 | 11/1967 | Bassett | 219/468 |
| 3,375,346 | 3/1968 | Gaugler | 219/449 |
| 3,443,144 | 5/1969 | Freese | 313/316 |
| 3,579,021 | 5/1971 | Kimball | 313/274 |
| 3,663,798 | 5/1972 | Speidel et al. | 219/464 |
| 3,714,885 | 2/1973 | Wertheimer et al. | 219/524 |
| 4,327,280 | 4/1982 | McWilliams | 219/461 |
| 4,350,875 | 9/1982 | McWilliams | 219/449 |
| 4,393,299 | 7/1983 | McWilliams | 219/468 |
| 4,414,465 | 11/1983 | Newton et al. | 219/449 |
| 4,430,558 | 2/1984 | McWilliams | 219/449 |

FOREIGN PATENT DOCUMENTS

| | | |
|---|---|---|
| 23748 | of 1913 | United Kingdom . |
| 735064 | 8/1955 | United Kingdom . |
| 2092869 | 8/1982 | United Kingdom . |
| 2132060 | 6/1984 | United Kingdom . |

*Primary Examiner*—E. A. Goldberg
*Assistant Examiner*—Teresa J. Walberg
*Attorney, Agent, or Firm*—Fleit, Jacobson, Cohn & Price

[57] ABSTRACT

A heating unit suitable for mounting in a cooking hob includes a circular tray having a layer of thermally-insulative material disposed therein and a peripheral thermally-insulative wall, within which four infra-red lamps, each containing a tungsten filament, are supported. The tray also includes an inner thermally-insulative wall, which encloses the length of each filament. Between the peripheral and inner walls, two conventional, wire-wound heating elements are disposed. The filaments and the elements are energizable independently and/or concurrently, and series and/or parallel combinations of the filaments and the elements may be switched to provide various discrete power outputs.

4 Claims, 7 Drawing Figures

HEATING APPARATUS

This is a divisional of application Ser. No. 733,802 filed May 14, 1985, now U.S. Pat. No. 4,639,579.

This invention relates to improvements in heating apparatus and in particular though not exclusively, to heating apparatus of the type disclosed in our co-pending U.K. Patent Application No. 8320717 (Publication No. 2132060A), incorporating one or more sources of infra-red radiation.

The heating apparatus disclosed in U.K. Patent Application No. 8320717 consists of, in one example, a shallow tray member containing a layer of thermally-insulative material, above which four infra-red-emitting, tungsten-halogen lamps are supported. The tray member, usually along with a number of similar members may be mounted beneath a layer of glass ceramic to form a cooking hob.

A thermal limiter is preferably provided in the heating apparatus to ensure that the maximum operating temperature of the glass ceramic is not exceeded. A number of discrete temperature settings are also provided by switching the lamps into series and/or parallel configurations, wherein one or more diodes are usually required to achieve one or more of the lower settings.

However, some problems may be found to occur under particular circumstances of operation of the apparatus, such as operation of the limiter causing it to trip and disconnect the power supply to the lamps, which may be a source of annoyance for a user of the apparatus, or it may not be desirable to use the diodes in the switching arrangement, as they tend to interfere with the harmonics of the main supply.

It is therefore an object of the present invention to provide heating apparatus which alleviates at least the above-mentioned potential problems, as well as being cost-effective.

According to the present invention, there is provided a heating unit suitable for mounting in a cooking hob, said unit comprising a base layer of thermally-insulative material, a peripheral thermally-insulative wall to define a first hotplate region, an inner thermally-insulative wall to define a second hotplate region located within said first region, at least one infra-red lamp each including a filament emissive of infra-red radiation and commensurate with said second hotplate region, further heating means commensurate with said first hotplate region, further heating means commensurate with said first hotplate region, and means for energizing said filament and said further heating means independently and concurrently, selectively.

The invention will be described by way of example only with reference to the accompanying drawings, wherein.

Figure 1:
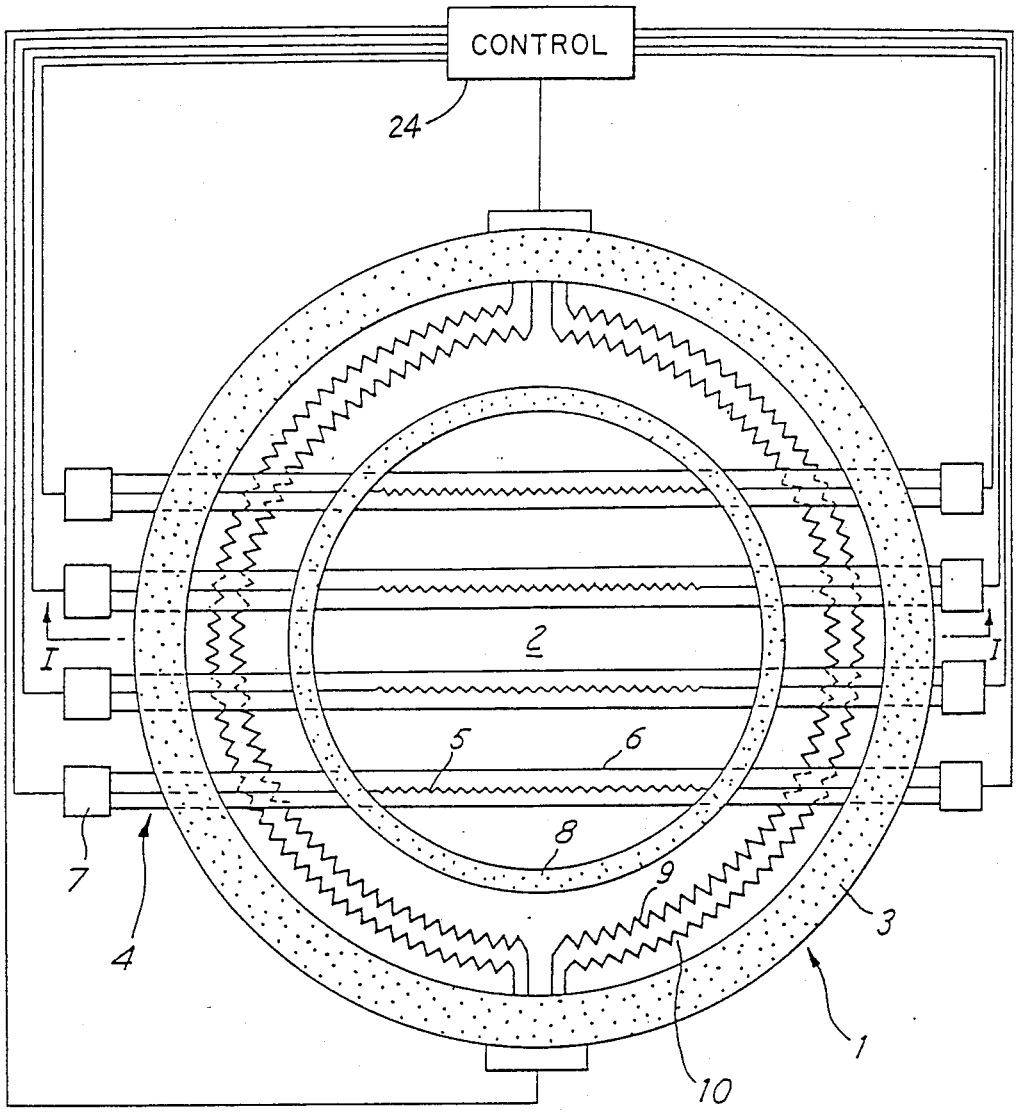
FIG. 1 shows a schematic plan view of one embodiment of the invention.
Figure 3A:
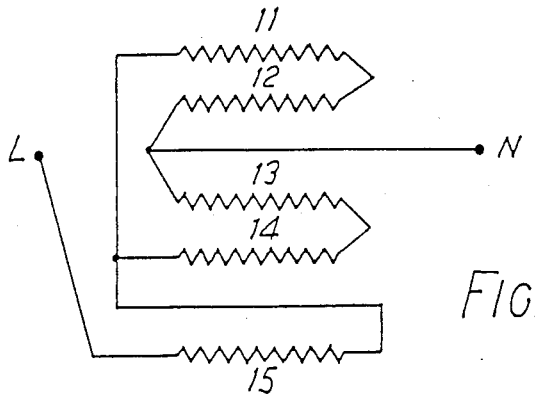
Figure 3B:
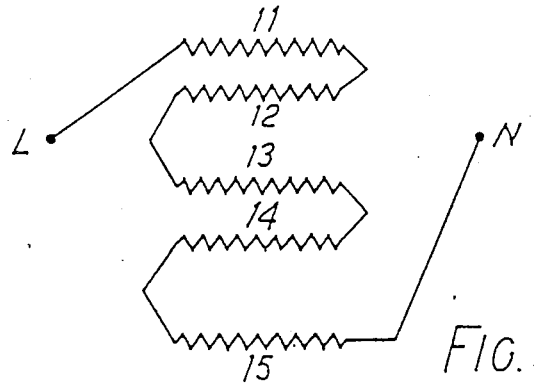
Figure 4:
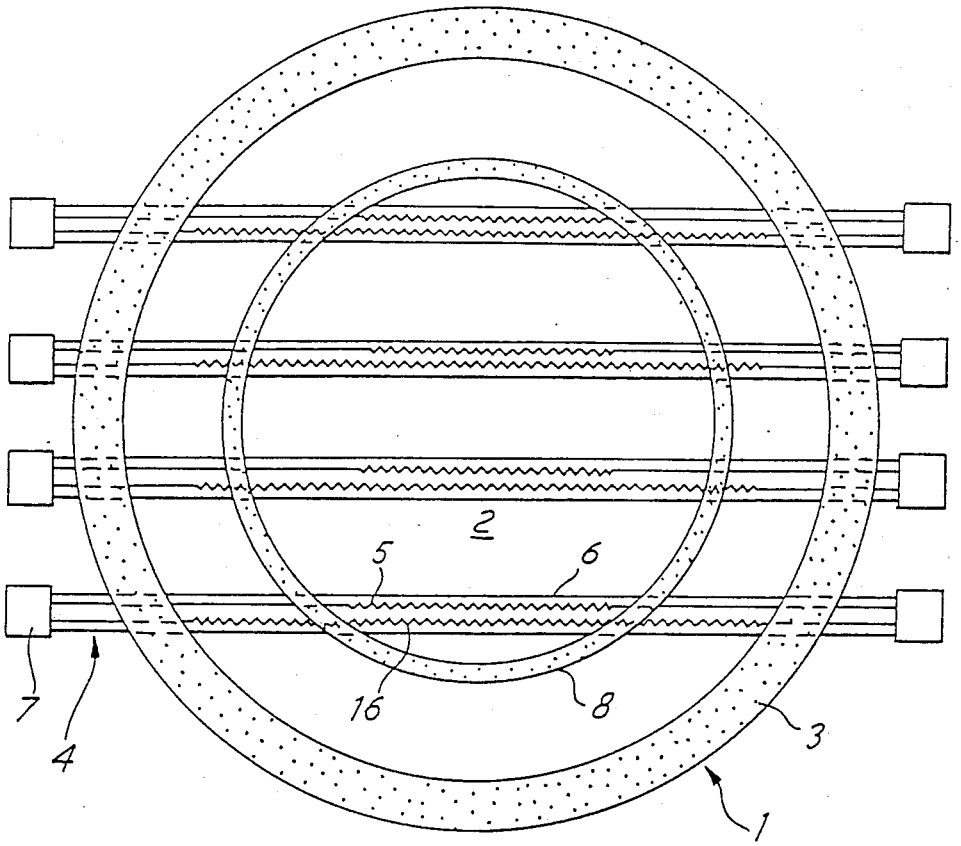
Figure 5:
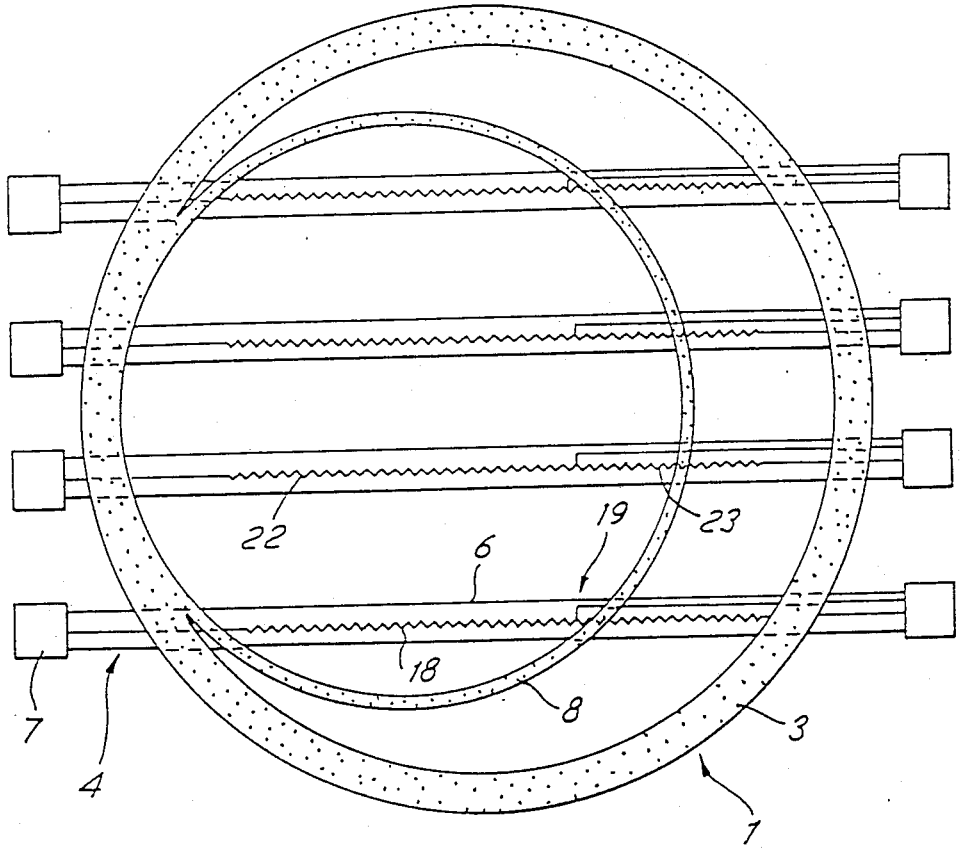
Figure 6:
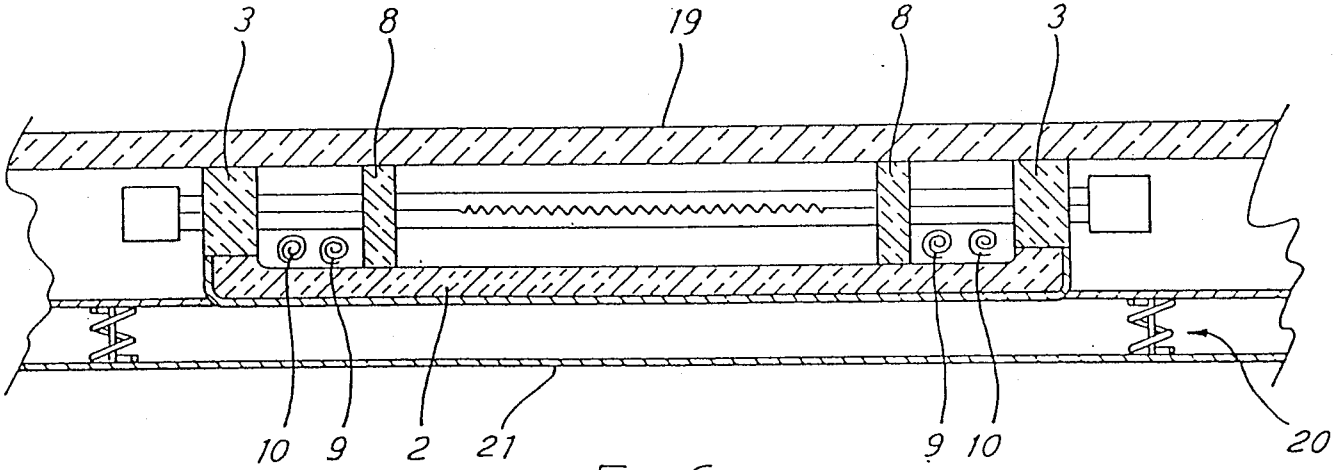

FIGS. 3*a* and 3*b* show switching arrangements to provide discrete power outputs in accordance with the invention, FIGS. 4 and 5 show two further embodiments of the invention, and FIG. 6 shows a schematic sectional view through I—I in FIG. 1 of the embodiment shown, mounted in a cooking hob.

Referring to FIG. 1, there is shown a heating unit consisting of a circular tray 1 having a layer 2 of thermally-insulative material, such as microporous material, disposed therein and a peripheral thermally-insulative wall 3, within which four infra-red lamps, one shown at 4, are supported. Each lamp 4 consists of tungsten filament 5 supported within a tubular quartz envelope 6, and each end of each lamp 4 is formed with a pinch seal (not shown), having a connection between the respective end of the filament 5 and an electrical connector sealed therein, each pinch seal being housed within a ceramic end cap, such as at 7.

The tray 1 also includes an inner thermally-insulative wall 8, which is concentric with the peripheral wall 3 and of such a diameter as to enclose the entire length of all of the filaments 5 within the lamps 4.

Between the peripheral wall 3 and the inner wall 8, two conventional, electrical, wire-wound heating elements 9 and 10 are disposed.

As shown in FIG. 6, the heating unit is preferably mounted beneath, and urged up towards, a glass ceramic plate 19, by a suitable mounting arrangement 20, to form a hotplate of a cooking hob. The mounting arrangement 20 is fixed to a base 21 of a housing for the cooking hob.

The four lamp filaments 5 and the two elements 9 and 10 may be energized independently and/or concurrently, by means of control 24, so that only the central hotplate region within the inner wall or alternatively the whole region may be heated. Furthermore, any combination of one or more lamps and one or both elements may be energised to provide various discrete power outputs, and thus temperature settings, whilst maintaining an aesthetically pleasing balanced effect of the lamps, as seen through the glass ceramic plate.

Preferably, a thermal limiter (not shown) either mechanical or electronic, is also employed within the heating apparatus to limit the operating temperature of the apparatus to prevent damage to the glass ceramic by overheating. It may be preferable for the limiter to control the heating elements 9 and 10 only, so that tripping of the limiter would not be so conspicuous, as only the elements, and not the lamps, would be de-energised if overheating occurred.

It may be preferable to arrange that switching of the lamp filaments into various series and/or parallel configurations provides relatively high power outputs and that energisation of one or both of the heating elements 9 and 10 provides lower power outputs.

Figure 2:
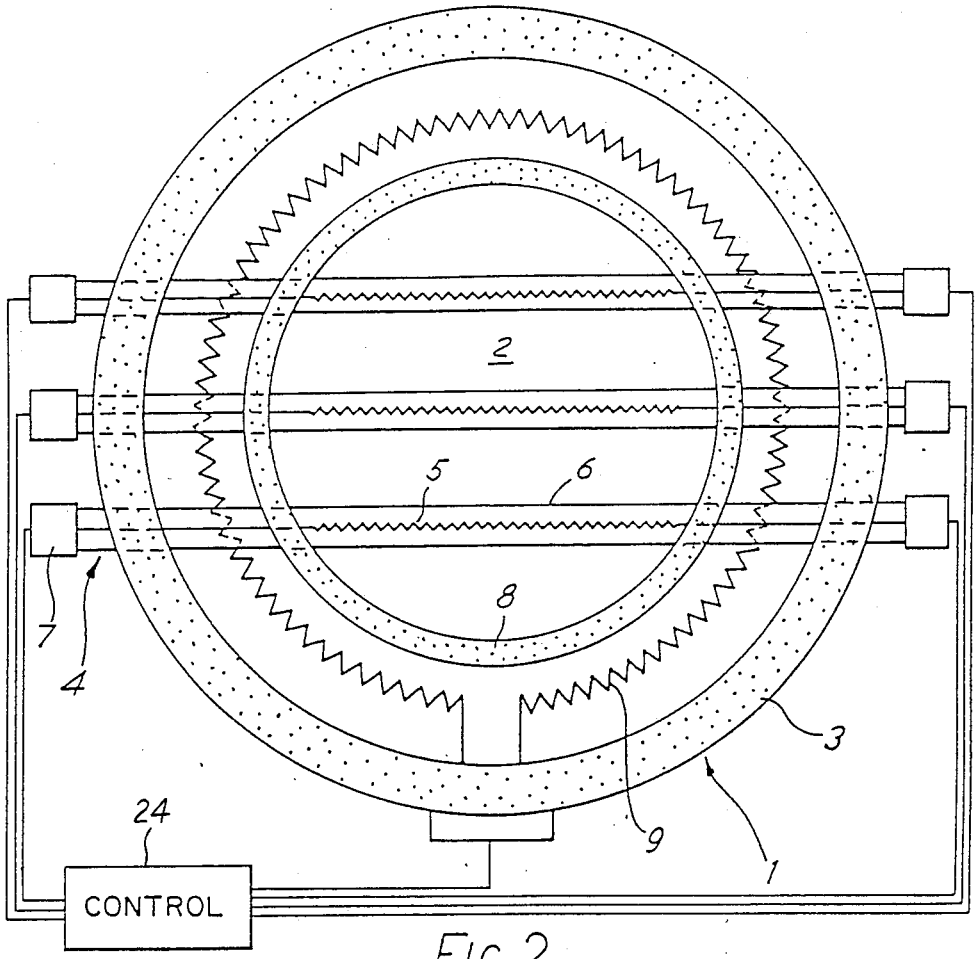
FIG. 2 shows an alternative embodiment to that shown in FIG. 1.

FIG. 2, wherein like parts are labelled with like reference numerals with respect to FIG. 1, shows an alternative embodiment to that shown in FIG. 1, wherein only three lamps, such as at 4, are provided in combination with only one heating element 9.

Such an arrangement, as shown in FIG. 2, may be advantageous in that one lamp has been replaced by a conventional heating element, thereby providing a cost saving in manufacture of the apparatus.

FIGS. 3*a* and 3*b* show the configurations of four lamp filaments 11 to 14 required to generate the third lowest and the lowest power outputs of the apparatus. The remaining configurations for the power outputs provided are shown in our above-mentioned co-pending U.K. Patent Application No. 8320717, wherein the configurations giving the same power outputs as those shown in FIGS. 3*a* and 3*b* also include one or more diodes to generate the required power output.

However, the use of these diodes may be disadvantageous, as they tend to cause harmonics disturbances in the mains power supply.

The present configurations shown in FIGS. 3*a* and 3*b* overcome this disadvantage by including an additional element 15 in series with the configuration formed by lamp filaments 11 to 14, which, when switched into the two configurations generates the same respective power outputs as when diodes are used. The element 15 may be either a fifth lamp filament or a conventional heating element as shown in FIGS. 1 and 2.

A further use of the additional element 15 may be as a pre-heating device to produce faster warm-up periods of the apparatus. The use of the element 15 would provide a high power output for an initial warm-up period, the length of which could be controlled by a timer and/or a thermal sensor device. The element 15 could also be used at various times during energisation of the lamp filaments 11 to 14, but preferably not continuously. Subsequent use of the element 15 after the initial warm-up period could be controlled manually.

The initial warm-up period could be controlled by any suitable type of timing device, so that the element 15 is de-energised at the end of a predetermined time, such as 6 mins. for example.

Alternatively or additionally, the initial warm-up period could be controlled by any suitable thermal device, including a pre-set thermostat disposed at any suitable location within the apparatus to cause de-energisation of element 15 when a certain operating temperature is attained. Possible advantages of using a pre-heating element 15 may be that power outputs exceeding the limit that the glass ceramic is capable of withstanding may be utilised, because it is only energised until the required operating temperature is attained, and additionally at lower outputs, a thermal limiter to protect the glass ceramic may not be required, as the glass ceramic should not exceed its limit at these lower outputs. This therefore may provide an additional cost saving.

However, if a limiter to protect the glass ceramic is employed, it may be necessary to cause the timer and/or thermal device controlling the pre-heating element 15 to by-pass the limiter, at least while the element 15 is initially energised, to prevent nuisance tripping of the limiter.

FIGS. 4 and 5, wherein like parts are also labelled with like reference numerals with respect to FIGS. 1 and 2, show two alternative embodiments which include an additional filament accommodated within each lamp, instead of a conventional heating element.

Each lamp, as at 4 shown in FIG. 4 accommodates a filament 5, the length of which is commensurate with the area of the inner hotplate region within the wall 8, and a second filament 16, the length of which is commensurate with the area of the whole hotplate region within the outer wall 3. The two filaments may be energised independently and/or concurrently as required.

The embodiment shown in FIG. 5 is provided with a non-central inner hotplate region within the inner wall 8, which is integral around part of its circumference with the outer wall 3. A lamp filament 18 is accommodated within each lamp 4, having a length commensurate with the area of the whole hotplate region. However, each filament 18 is tapped at a point 19 along its length, so that, if required only the filament length coinciding with the area of the inner hotplate region may be energised. Filament 18 thus effectively consists of a filament 22 commensurate the inner hotplate region and an extended portion 23 thereof commensurate with the whole hotplate region.

The embodiments shown in FIGS. 4 and 5 may be advantageous in providing an increased number of switching combinations of the filaments, especially if they are maintained at a 100% output, as well as being cost-effective, because two filaments are accommodated within only one lamp.

In the preferred embodiment of the heating apparatus disclosed in U.K. Patent Application No. 8320717, each lamp is provided with an infra-red-reflective coating applied to the lower half of the quartz envelope, to reflect radiation emitted downwardly from the filaments back in an upwards direction towards the glass ceramic plate.

It may however be preferable to provide a suitable infra-red reflector between the lamps and the layer 2 of thermally-insulative material, which may be cost-effective and easier to manufacture.

It can of course be envisaged that some of the different embodiments shown in the Figures could be used in combination with each other, as well as each embodiment being used in isolation.

We claim:

1. A heating unit suitable for mounting in a cooking hob, said unit comprising:

a base layer of thermally-insulative material;

a peripheral thermally-insulative wall defining a first hot-plate region;

an inner thermally-insulative wall defining a second hot-plate region located within said first region;

a lamp having first and second pinch seals and electrical connection means sealed in said pinch seals, said lamp comprising a tubular envelope and means for emitting infra-red radiation supported in said envelope;

means for supporting said lamp such that said envelope extends across said first hotplate region and said first and second pinch seals are located outside of said first region;

said means for emitting infra-red radiation comprising a first length of linear filament commensurate with said first region and a second length of linear filament commensurate with said second region, at least said first length having first and second ends connected respectively to said electrical connection means sealed in said first and second pinch seals; and means, connectable to said electrical connection means, for energizing said first and second filament lengths independently and concurrently, selectively.

2. A heating unit suitable for mounting in a cooking hob, said unit comprising:

a base layer of thermally-insulative material;

a peripheral thermally-insulative wall defining a first hot-plate region;

an inner thermally-insulative wall defining a second hot-plate region located within said first region;

a lamp having first and second ends, said lamp comprising a tubular envelope and means for emitting infra-red radiation supported in said envelope;

means for supporting said lamp such that said envelope extends across said first hotplate region and said first and second ends are located outside of said first region;

said means for emitting infra-red radiation comprising a first length of linear filament commensurate with said first region and a second length of linear filament commensurate with said second region, said first and second filament lengths comprising two separate linear filaments positioned substantially parallel to each other within said envelope; and means, connectable to said lamp, for energizing said first and second filament lengths independently and concurrently, selectively.

3. A heating unit suitable for mounting in a cooking hob, said unit comprising:

a base layer of thermally-insulative material;

a peripheral thermally-insulative wall defining a first hot-plate region;

an inner thermally-insulative wall defining a second hot-plate region located within said first region;

a lamp having first and second ends, said lamp comprising a tubular envelope and means for emitting infra-red radiation supported in said envelope;

means for supporting said lamp such that said envelope extends across said first hotplate region and said first and second ends are located outside of said first region;

said means for emitting infra-red radiation comprising a first length of linear filament commensurate with said first region and a second length of linear filament commensurate with said second region, said second filament length comprising a portion of said first filament length, said portion being commensurate with said second region; and means, connectable to said lamp, for energizing said first and second filament lengths independently and concurrently, selectively.

4. A cooking hob comprising:

an open-topped housing;

a plate of material transmissive of infra-red radiation;

means for supporting said plate so that it closes said housing;

at least one heating unit disposed within said housing; and means for mounting said at least one heating unit adjacent the underside of said plate;

said heating unit comprising a base layer of thermally-insulative material, a peripheral thermally-insulative wall defining a first hotplate region, an inner thermally-insulative wall defining a second hotplate region located within said first region, a lamp having first and second pinch seals and electrical connection means sealed in said pinch seals, said lamp comprising a tubular envelope and means for emitting infra-red radiation supported in said envelope, means for supporting said lamp such that said envelope extends across said first hotplate region and said first and second pinch seals are located outside of said first region, said means for emitting infra-red radiation comprising a first length of linear filament commensurate with said first region and a second length of linear filament commensurate with said second region, at least said first length having first and second ends connected repectively to said electrical connection means sealed in said first and second pinch seals and means, connectable to said electrical connection means, for energizing said first and second filament lengths independently and concurrently, selectively.

* * * * *